US006718953B1

(12) United States Patent
Torgerud

(10) Patent No.: US 6,718,953 B1
(45) Date of Patent: Apr. 13, 2004

(54) FUEL VAPOR SEPARATOR WITH A FLOW DIRECTING COMPONENT WITHIN A FUEL RECIRCULATING FLOW PATH

(75) Inventor: Michael A. Torgerud, Mount Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 20 days.

(21) Appl. No.: 10/199,765

(22) Filed: Jul. 19, 2002

(51) Int. Cl.[7] ..... F02M 37/04
(52) U.S. Cl. ..... 123/516; 123/519
(58) Field of Search ..... 123/516, 519, 123/509, 514

(56) References Cited

U.S. PATENT DOCUMENTS

| | | | | |
|---|---|---|---|---|
| 4,809,666 A | | 3/1989 | Baltz | 123/516 |
| 4,844,043 A | | 7/1989 | Keller | 123/516 |
| 5,103,793 A | | 4/1992 | Riese et al. | 123/516 |
| 5,119,790 A | | 6/1992 | Olson | 123/516 |
| 5,137,002 A | | 8/1992 | Mahoney et al. | 123/516 |
| 5,309,885 A | | 5/1994 | Rawlings et al. | 123/509 |
| 5,368,001 A | * | 11/1994 | Roche | 123/516 |
| 5,579,740 A | * | 12/1996 | Cotton et al. | 123/516 |
| 5,647,331 A | | 7/1997 | Swanson | 123/516 |
| 5,653,103 A | | 8/1997 | Katoh | 60/283 |
| 5,855,197 A | | 1/1999 | Kato | 123/516 |
| 5,924,409 A | | 7/1999 | Kato | 123/463 |
| 6,009,859 A | | 1/2000 | Roche et al. | 123/509 |
| 6,012,434 A | | 1/2000 | Hartke et al. | 123/516 |
| 6,216,672 B1 | * | 4/2001 | Mishima et al. | 123/516 |
| 6,253,742 B1 | | 7/2001 | Wickman et al. | 123/516 |
| 6,257,208 B1 | | 7/2001 | Harvey | 123/516 |
| 6,279,546 B1 | | 8/2001 | Nakase et al. | 123/516 |
| 6,318,344 B1 | | 11/2001 | Lucier et al. | 123/516 |
| 6,422,255 B1 | * | 7/2002 | Hartke et al. | 123/516 |
| 6,527,603 B1 | * | 3/2003 | Wickman | 123/509 |
| 6,553,974 B1 | * | 4/2003 | Wickman | 123/516 |

* cited by examiner

*Primary Examiner*—Thomas N. Moulis
(74) *Attorney, Agent, or Firm*—William D. Lanyi

(57) ABSTRACT

A fuel delivery system for a marine engine provides first, second, and third reservoirs of a fuel vapor separator and first, second, and third pumps to cause fuel to be drawn from the fuel tank and provided to the combustion chambers of an internal combustion chamber. A flow directing component is provided to inhibit recirculated fuel from mixing directly with fuel within the fuel vapor separator that has not yet been pumped to a fuel rail. The flow directing component receives recirculated fuel and also receives fuel from a second reservoir through an orifice formed through a surface of the flow directing component.

19 Claims, 4 Drawing Sheets

FUEL VAPOR SEPARATOR WITH A FLOW DIRECTING COMPONENT WITHIN A FUEL RECIRCULATING FLOW PATH

BACKGROUND OF THE INVENTION

1. Field of the Invention

The present invention is generally related to a fuel vapor separator and, more particularly, to a fuel vapor separator that inhibits fuel, flowing within a recirculation path from a fuel rail, from freely mixing with liquid fuel within a main fuel reservoir of the fuel vapor separator.

2. Description of the Prior Art

Fuel vapor separators are well known to those skilled in the art. One of the functions of the fuel vapor separator is to allow gaseous fuel vapor to be separated from liquid fuel that is pumped to a fuel delivery component, such as a fuel rail for a plurality of fuel injectors. Fuel vapor separators are provided for use in conjunction with internal combustion engines, such as those used in marine propulsion systems. In some applications, fuel is pumped from the fuel vapor separator to a fuel rail or other fuel delivery component and excess fuel is recirculated back to the fuel vapor separator. In other systems, fuel is "dead-headed" so that the fuel flows in a single direction from a fuel pump to a fuel rail or other fuel delivery component.

U.S. Pat. No. 6,318,344, which issued to Lucier et al on Nov. 20, 2001, describes a dead-headed fuel delivery system using a single fuel pump. The fuel delivery system uses a single electric fuel pump to deliver fuel to a two-stroke fuel injected engine. The fuel pump draws fuel from a fuel tank via a fuel supply network or a fuel supply line, transfers the fuel through a fuel connecter and a fuel filter, and delivers the fuel to a vapor separator. The fuel is then distributed to the fuel injectors without returning any fuel to the fuel delivery system. An engine control unit, connected to a pressure sensor, supplies a fuel supply signal to the fuel pump to maintain the supplied pressure at a reference pressure.

U.S. Pat. No. 6,279,546, which issued to Nakase et al on Aug. 28, 2001, describes a watercraft fuel supply system. The fuel delivery and injection system for a small watercraft engine reduces the heat effects within an enclosed engine compartment upon a fuel pump of and the fuel within a fuel injection system. The fuel delivery system includes a vapor separator and a high pressure fuel pump. The fuel pump is at least partially located within the vapor separator. The fuel within the vapor separator cools the fuel pump. The vapor separator also is positioned between a pair of air ducts such that an air stream between the ducts cools the fuel within the vapor separator. This arrangement consequently improves the consistency of the air/fuel ratio and the fuel charges delivered to the engine cylinders, provides a compact structure between the fuel pump, and the vapor separator and improves the durability of the fuel pump.

U.S. Pat. No. 6,257,208, which issued to Harvey on Jul. 10, 2001, describes a marine vapor separator. A method of controlling fuel temperature while supplying fuel from a fuel tank to an array of fuel injectors of an internal combustion engine comprises the steps of pumping the fuel with a high pressure pump, flowing the fuel through a fuel line from the fuel tank to the high pressure pump, and flowing the fuel through a vapor separator to the fuel line between the tank and the high pressure pump. The method is characterized by recirculating fuel from the vapor separator to the fuel line and leveling fuel temperatures. The method is more specifically characterized by regulating the pressure at which fuel is recirculated from the vapor separator to the fuel line. An assembly for implementing the method includes a unitary housing comprising an upper cap and a lower cap for supporting the filter, the lower pressure pump, the first pressure regulator, and the vapor separator. A baffle is disposed at the bottom of the vapor separator for separating fuel flow from the low pressure pump on a first side of the baffle from fuel returning by the return line disposed on the second side of the baffle. The first pressure regulator and the recirculation line are also disposed on the first side of the baffle.

U.S. Pat. No. 6,253,742, which issued to Wickman et al on Jul. 3, 2001, discloses a fuel supply method for a marine propulsion engine. The method for controlling the operation of a fuel system of an outboard motor uses a lift pump to transfer fuel from a remote tank to a vapor separator tank. Only one level sensor is provided in the vapor separator tank and an engine control unit monitors the total view usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

U.S. Pat. No. 6,012,434, which issued to Hartke et al on Jan. 11, 2000, describes a fuel system vapor separator for an internal combustion engine. The vapor separator has an outer housing member with a generally cylindrical internal wall and has two open opposed ends. A generally cylindrical inner housing member is fitted within the outer housing member and defines a sealed space between the two housing members. The housing members are sealingly closed at both ends. An inlet introduces fuel into the central region of the inner housing member while another inlet introduces a coolant fluid into the space defined between the outer and inner housing members for cooling the fuel. A float operated valve vents out fuel vapor accumulating within the inner housing member. The housing members are formed by an extrusion process such that they can be cut to various lengths depending upon the desired size of the assembled vapor separator.

U.S. Pat. No. 6,009,859, which issued to Roche et al on Jan. 4, 2000, describes a liquid cooled in-line fuel pump. The fuel system for a fuel injected internal combustion engine has a liquid cooled fuel pump which draws fuel from a liquid vapor separator and delivers it under pressure to the engine at a rate higher than that necessary to operate the engine. Preferably, a fuel pressure regulator downstream of the fuel pump and adjacent to the engine bypasses excess fuel to a return fuel chamber in communication with the liquid cooled fuel pump to cool the return fuel before it is returned to the liquid vapor separator. Reducing the temperature of the return fuel before it is discharged into the liquid vapor separator reduces the generation of vapor in the liquid vapor separator and thereby enables use of the smaller, less expensive vapor separator. Reducing the amount of fuel vapor in the system is desirable because the fuel vapor can decrease the efficiency and life of the fuel pump and is environmentally hazardous.

U.S. Pat. No. 5,924,409, which issued to Kato on Jul. 20, 1999, describes a fuel injection system. The system is for an internal combustion engine and provides a uniform flow of gaseous and liquid fuel to each of the intake passages of the engine. A balance passage interconnects each of the intake manifolds to each other and balances the pressure within the intake passages. A pressure regulator regulates the fuel pressure at the fuel injector. A reference pressure chamber within the pressure regulator communicates with the balance passage and controls the fuel pressure based on the balanced pressure within the intake passages. The balance passage also communicates with a vapor separator of the fuel supply system that separates liquid fuel from gaseous fuel. The balance passage promotes even distribution of the gaseous fuel to the intake passages. The fuel injection system also includes a plenum chamber that acts as a source of air for the engine. The plenum chamber includes a drain outlet that communicates with the balance passage for returning blown back fuel from the plenum chamber to the intake passages.

U.S. Pat. No. 5,855,197, which issued to Kato on Jan. 5, 1999, describes a vapor separator for a fuel injected engine. The vapor separator for a fuel injection system reduces the size of the fuel system mounted on the side of an outboard engine. The girth of the outboard motor's powerhead consequently is decreased. In one embodiment, the vapor separator employs a plurality of rotary vane pumps. The pumps are sized to produce a sufficient flow rate and fuel pressure, while minimizing power consumption. At least one of the fuel pumps can be located on a periphery of a housing of the vapor separator and can be removably attached thereto to facilitate easy removal and assembly for service and repair. The vapor separator can also include a redundant seal arrangement to generally isolate an exterior casing of the fuel pump from the fuel and to seal an upper end of the housing. In another embodiment, a dividing wall separates the fuel pump from a fuel supply inlet of the fuel tank. The wall inhibits gas bubble migration toward the inlet of the fuel pump. The fuel pump thus draws less vapor.

U.S. Pat. No. 5,653,103, which issued to Katoh on Aug. 5, 1997, describes a fuel supply for an injected engine. An internal combustion engine with a fuel vapor reduction arrangement, including a combustion chamber, an induction system for introducing an air/fuel charge to the combustion chamber, a fuel charge forming system for supplying a fuel charge to the combustion chamber, an exhaust system for releasing combustion exhaust from the combustion chamber to the atmosphere, and a fuel supply system for supplying fuel to the fuel charge forming system is described. The fuel system includes a fuel vapor separator and a fuel vapor conduit connecting the fuel vapor separator to a point of the engine so that fuel vapors are not directly released to the atmosphere and do not interfere with the air fuel ratio in the engine.

U.S. Pat. No. 5,647,331, which issued to Swanson on Jul. 15, 1997, describes a liquid cooled fuel pump and vapor separator. An electric fuel pump is housed in an aluminum body module formed by two isopods open end to open end to provide a multi-cavity module housing of heat conductive material. The pump inlet faces downwardly in one of the cavity and a small clearance volume directly surrounds the pump casing which, in one embodiment, is filled with liquid fuel and in another with cooling water. Another module cavity forms a fuel sump at its lower end and a vapor separator chamber at its upper end. Fuel is supplied from a fuel tank at a low pressure up to a flow operated inlet needle valve in the vapor separator/sump cavity and a fuel passage communicates the sump with the pump inlet casing. The fuel collects as a pump inlet reserve supply in the sump at atmospheric pressure, or slightly thereabove. Vapor separates from the fuel into the pump headspace and is vented via a suitable vapor pressure regulator.

U.S. Pat. No. 5,309,885, which issued to Rawlings et al on May 10, 1994, describes a marine propulsion device including a fuel injected, four cycle internal combustion engine. An internal combustion engine comprises an engine block including a combustion chamber, a fuel vapor separator, a fuel supply mechanism for introducing fuel to the combustion chamber, a conduit communicating between the fuel vapor separator and the fuel supply mechanism for introducing fuel, and a cooling jacket for cooling the fuel vapor separator.

U.S. Pat. No. 5,137,002, which issued to Mahoney et al on Aug. 11, 1992, describes a vapor separator. An engine assembly comprising an internal combustion engine, a vapor separator including a fuel inlet adapted to communicate with a source of fuel, a fuel outlet communicating with the engine, a vapor outlet, and a valve mechanism operatively connected to the engine for opening the vapor outlet in response to operation of the engine and for closing the vapor outlet in response to a non-operation of the engine is described.

U.S. Pat. No. 5,119,790, which issued to Olson on Jun. 9, 1992, describes a fuel feed system. The device provides a fuel feed system for an internal combustion engine. The system includes a vapor separator having a wall defining a fuel chamber adapted to contain a supply of fuel and having therein an inlet, an outlet and a fuel vapor outlet, and a float drive for affording communication between the fuel vapor outlet and the chamber when the supply of fuel is below a predetermined level. The float valve includes a spring engaged with a valve member for applying constant force to the valve member when the valve is closed.

U.S. Pat. No. 5,103,793, which issued to Riese et al on Apr. 14, 1992, discloses a vapor separator for an internal combustion engine. The vapor separator assembly for an internal combustion engine includes a bowl member and a cover member. A fuel pump is located in the internal cavity of the bowl member and has its inlet located in the lower portion of the bowl member cavity, for supplying fuel thereto. The fuel pump is secured in position within the bowl member by engagement of the cover member with the fuel pump. The cover member includes a mounting portion for mounting a water separating filter element to the vapor separator assembly. The cover member includes a structure for routing fuel from the discharge of the water separating filter element to the interior of the bowl member internal cavity. A compact arrangement is thus provided for the vapor separator, the fuel pump and the water separating filter, eliminating a number of hose connections between such components as well as facilitating assembly to the engine.

U.S. Pat. No. 4,844,043, which issued to Keller on Jul. 4, 1989, discloses an anti vapor lock carbureted fuel system. A marine fuel system includes a first crankcase pressure driven fuel pump supplying fuel from a remote fuel tank to a vapor separator, and a second crankcase pressure driven fuel pump supplying vapor free fuel from the vapor separator to the carburetors of the engine. In combination, a squeeze bulb and a one way check valve supply fuel from the remote fuel tank directly to the carburetors for starting the engine.

U.S. Pat. No. 4,809,666, which issued to Baltz on Mar. 7, 1989, describes a fuel feed system. The system is intended for supplying fuel to a combustion chamber of a first internal combustion engine and to a combustion chamber of a second internal combustion engine. The fuel feed system includes a fuel tank and a first fuel pump including an outlet and an inlet communicating with the fuel tank. The system also includes a fuel vapor separator including a first outlet, a second outlet, and an inlet communicating with the first fuel pump outlet, a second fuel pump communicating with the fuel vapor separator first outlet and communicating with the first engine combustion chamber, and a third fuel pump communicating with a fuel vapor separator second outlet and communicating with a second engine combustion chamber.

The patents described above are hereby expressly incorporated by reference in the description of the present invention.

As is well known to those skilled in the art, it is important to appropriately manage the fuel flow within a fuel system of a marine engine to avoid unnecessarily raising the temperature of the fuel within a fuel vapor separator. It is also important to manage the return flow of recirculating fuel from a fuel rail, or other fuel supply component, in order to avoid excessive mixing of this warmer recirculated fuel with cooler fuel contained within the main reservoir of the fuel vapor separator. It would therefore be significantly beneficial if a system could be provided that directs recirculating fuel, flowing from a fuel rail or fuel system component back to the fuel vapor separator, toward the inlet of a high pressure pump that is pumping fuel to that fuel rail or fuel system component rather than allowing the recirculating fuel to readily mix with cooler fuel contained within the fuel vapor separator.

SUMMARY OF THE INVENTION

A fuel delivery system for a marine engine, made in accordance with the preferred embodiment of the present invention, comprises first and second reservoirs and a first pump which has an inlet that is connected in fluid communication with the second reservoir and an outlet that is connectable in fluid communication with a fuel delivery component of the marine engine, such as a fuel rail. It further comprises a second pump having an inlet connected in fluid communication with the first reservoir and an outlet connected in fluid communication with the second reservoir. A flow directing component is provided and has an internal cavity which is connected in fluid communication with the inlet of the first pump. The flow directing component has an orifice that connects the internal cavity of the flow directing component in fluid communication with the second reservoir. The present invention further comprises a check valve connected in fluid communication between the first and second reservoirs in order to allow fluid fuel to flow from the second reservoir into the first reservoir in response to a pressure of the fluid within the second reservoir exceeding a predetermined threshold.

A preferred embodiment of the present invention can further comprise a third reservoir connected in fluid communication with the first reservoir and a fuel filter disposed within the third reservoir.

A preferred embodiment of the present invention further comprises a third pump having an outlet connected in fluid communication with the third reservoir and an inlet connectable in fluid communication with a fuel tank. The fuel filter is connected in fluid communication between the outlet of the third pump and the first reservoir. The fuel filter can be a water separating fuel filter. The fuel delivery component can comprise a fuel rail and the fuel rail can be connected in fluid communication between the outlet of the first pump and a return conduit connected in fluid communication with the internal cavity, whereby fuel is pumped into the fuel rail by the first pump and a quantity of the fuel can return to the internal cavity through a recirculation conduit.

In a particularly preferred embodiment of the present invention, the first pump is disposed within the first reservoir, the second reservoir is disposed within the first reservoir, and the flow directing component is disposed within the second reservoir. The second pump can be disposed within the first reservoir.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
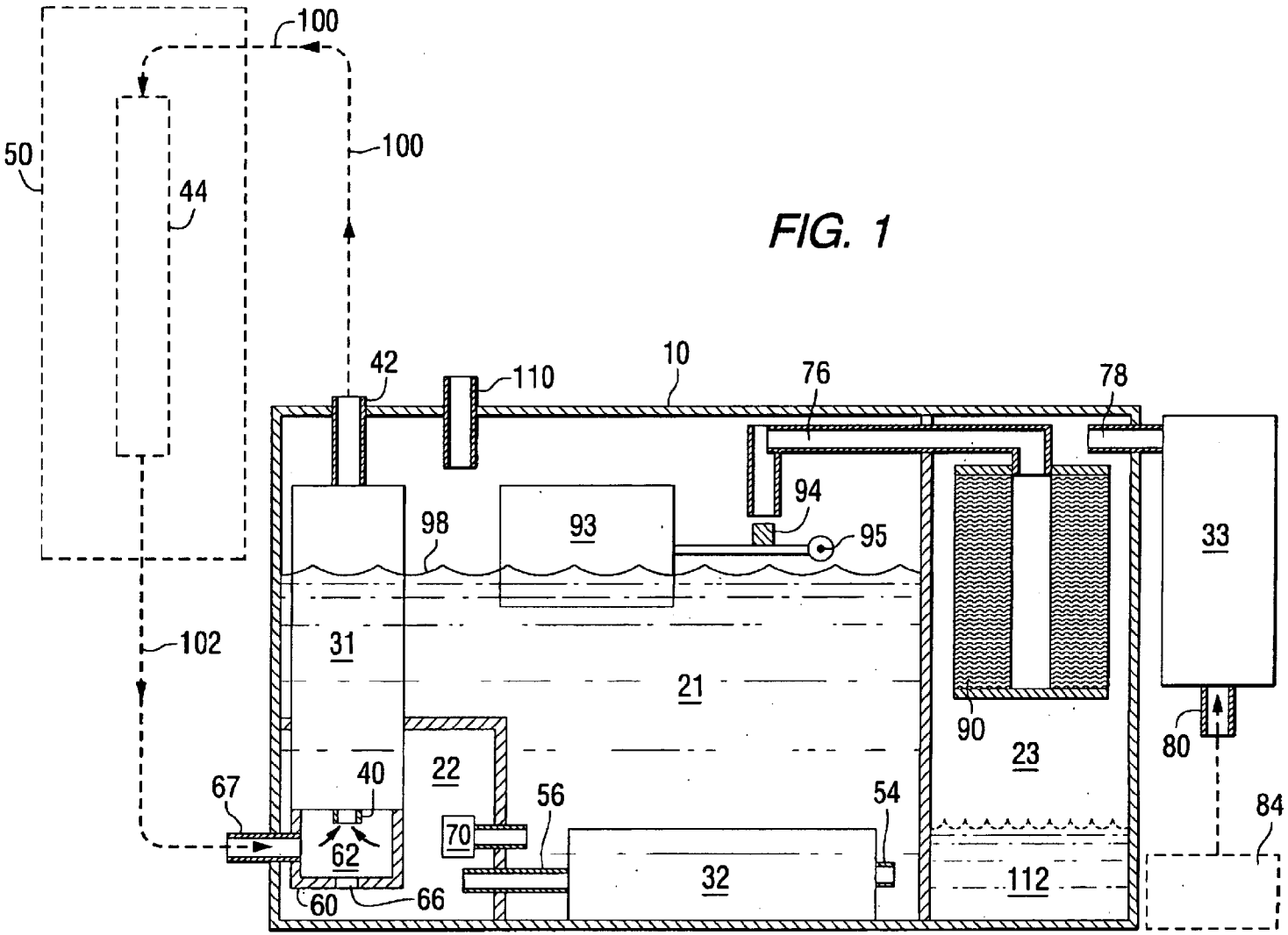
FIG. 1 is a schematic representation of a fuel system incorporating the present invention.

Throughout the description of the preferred embodiment of the present invention, like components will be identified by like reference numerals.

FIG. 1 is a simplified schematic representation of a fuel delivery system incorporating the present invention. A fuel vapor separator 10 comprises a first reservoir 21, a second reservoir 22, and a third reservoir 23. It also comprises a first pump 31, a second pump 32, and a third pump 33. The first pump 31 has an inlet 40 that is connected in fluid communication with the second reservoir 22 and an outlet 42 that is connectable in fluid communication with a fuel delivery component, such as the fuel rail 44 of a marine engine 50. The fuel rail 44 and the marine engine 50 are represented by dashed lines in FIG. 1. It should be understood that the particular details of the design of the fuel rail 44 and the internal combustion engine 50 are not limiting to the present invention.

A second pump 32 has an inlet 54 connected in fluid communication with the first reservoir 21 and an outlet 56 connected in fluid communication with a second reservoir 22. A flow directing component 60 has an internal cavity 62 which is connected in fluid communication with the inlet 40 of the first pump 31. The flow directing component 60 has an orifice 66 that connects the internal cavity 62 in fluid communication with the second reservoir 22.

A check valve 70 is connected in fluid communication between the first and second reservoirs, 21 and 22, in order to allow fluid to flow from the second reservoir 22 into the first reservoir 21 in response to a pressure of the fluid within the second reservoir 22 exceeding a predetermined threshold. In a preferred embodiment of the present invention, the predetermined threshold can be approximately 25 PSI.

The third reservoir 23 is connected in fluid communication with the first reservoir 21 by conduit 76. The third pump 33 has an outlet 78 connected in fluid communication with the third reservoir 23 and an inlet 80 that is connectable in fluid communication with a fuel tank 84 which is represented by a dashed box in FIG. 1. A fuel filter 90 is disposed within the third reservoir 33 and connected in fluid communication between the outlet 78 of the third pump 33 and the first reservoir 21. The filter 23, in a preferred embodiment of the present invention is a water separating fuel filter.

In operation, the third pump 33 draws fuel from the fuel tank 84 and pumps the fuel, through its outlet 78 into the third reservoir 23. The fuel is conducted into the region of the third reservoir 23 that surrounds the filter 90. In response to pressure differentials, the fuel then flows readily inwardly through the filter media to the central conduit of the filter 90 and then through conduit 76 into the first reservoir 21. A float 93 operates a valve member 94 by pivoting about axis 95 in response to changes in the liquid level 98 of fuel within the first reservoir 21. The valve 94 blocks conduit 76 when the fuel level 98 reaches a preselected level. The second pump 32 pumps liquid fuel from the first reservoir 21, through the outlet 56 of the second pump 32, into the second reservoir 22. As fuel is used by the engine 50, a pressure differential induces a flow of fuel from the second reservoir 22, through orifice 66, into the internal cavity 62 of the flow directing component 60. This fuel is then drawn into the inlet 40 of the first pump 31 and pumped to the fuel rail 44, as indicated by dashed arrows 100. During the operation of the engine 50, some fuel is consumed in the cylinders and any excess fuel in the fuel rail 44 is returned in a recirculation path which is represented by dashed line arrows 102. This recirculating fuel flows into the internal cavity 62 and is again pumped by the first pump 31 back to the fuel rail 44. During this recirculating of fuel, some fuel is consumed by the engine 50 and that consumed fuel is replaced by the fuel flowing from the second reservoir 22 into the internal cavity 62 through orifice 66.

Any fuel pumped into the second reservoir 22 by the second pump 32 which is not drawn through orifice 66 is returned, through the check valve 70 to the first reservoir 21 when the pressure within the second reservoir 22 exceeds a preselected magnitude, such as 25 PSI. It is important to understand that recirculating fuel flowing through the recirculation conduit, represented by dashed line arrow 102, is inhibited from mixing with the fuel within the second reservoir 22 that is not contained within the internal cavity 62. Otherwise, the warmer fuel flowing through the recirculation circuit from the fuel rail 44 would raise the temperature of the fuel within the second reservoir 22. In response to additional fuel being pumped into the second reservoir 22 by the second pump 32, this mixture of warmer recirculated fuel and the fuel within the second reservoir 22 would pass into the first reservoir 21. As a result, the liquid fuel within the first reservoir 21 would increase in temperature and eventually vaporize at an excessive rate. This could cause liquid fuel to flow out of the first reservoir 21 through the vapor vent conduit 110.

With continued reference to FIG. 1, reference numeral 112 represents a quantity of water collected within the third reservoir 23 as a result of the operation of the water separating fuel filter 90. The contents of the third reservoir 23 above the water 112 include fuel that has not yet passed radially inwardly through the filtering media of the filter 90, through conduit 76, and into the first reservoir 21.

Figure 2:
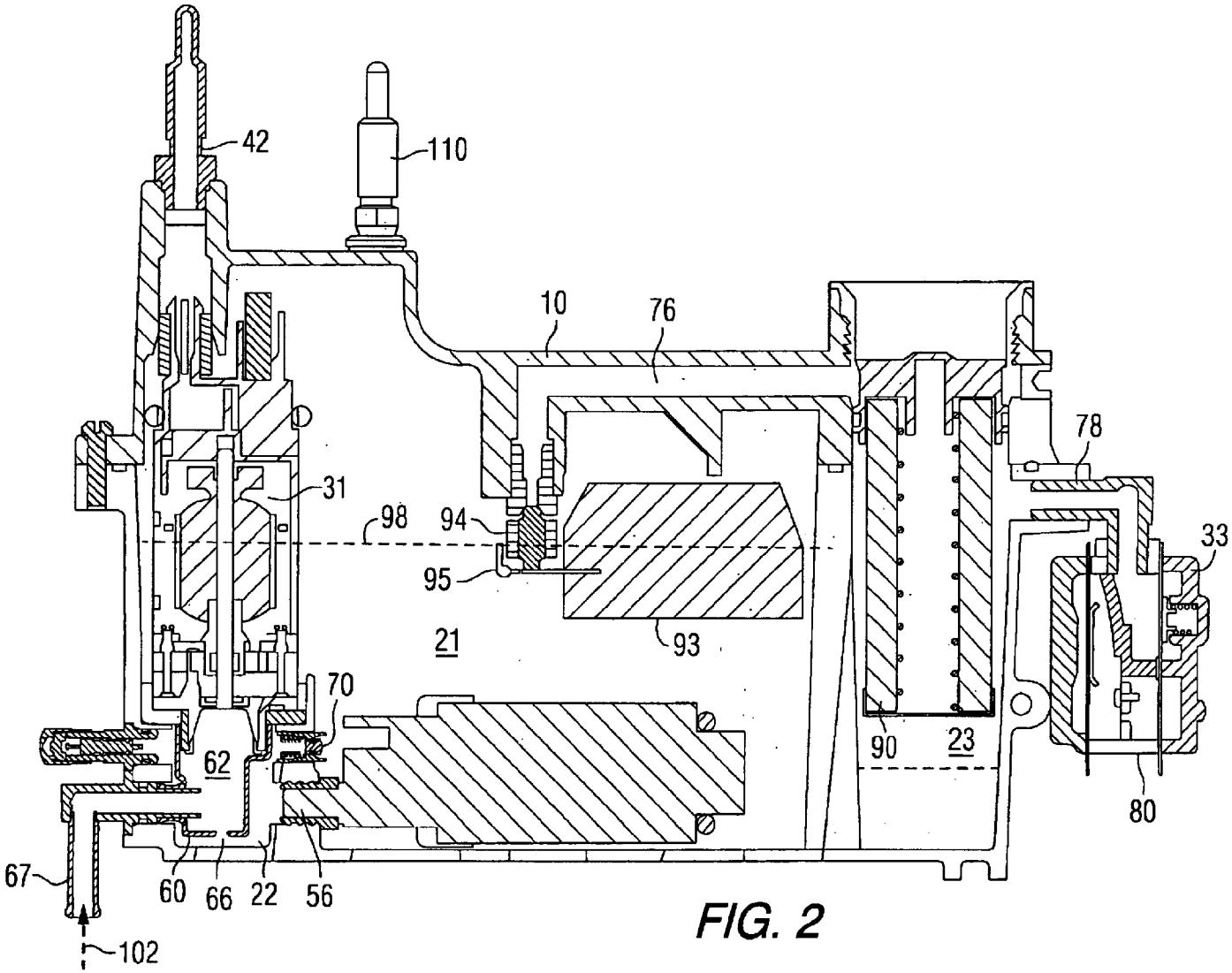
FIG. 2 is a section view of a preferred embodiment of the present invention.

FIG. 2 is a section view taken through a fuel vapor separator 10 made in accordance with the preferred embodiment of the present invention. It should be understood that FIG. 1 is a highly simplified schematic representation that is intended to show all of the components of the present invention in a clear and understandable manner and to facilitate an explanation of the operation of the present invention. FIG. 2 shows an actual structure that embodies the present invention, but is more complex than the structure in FIG. 1 and, therefore, does not easily illustrate all of the fluid flows and conduits associated with the present invention.

Figure 3:
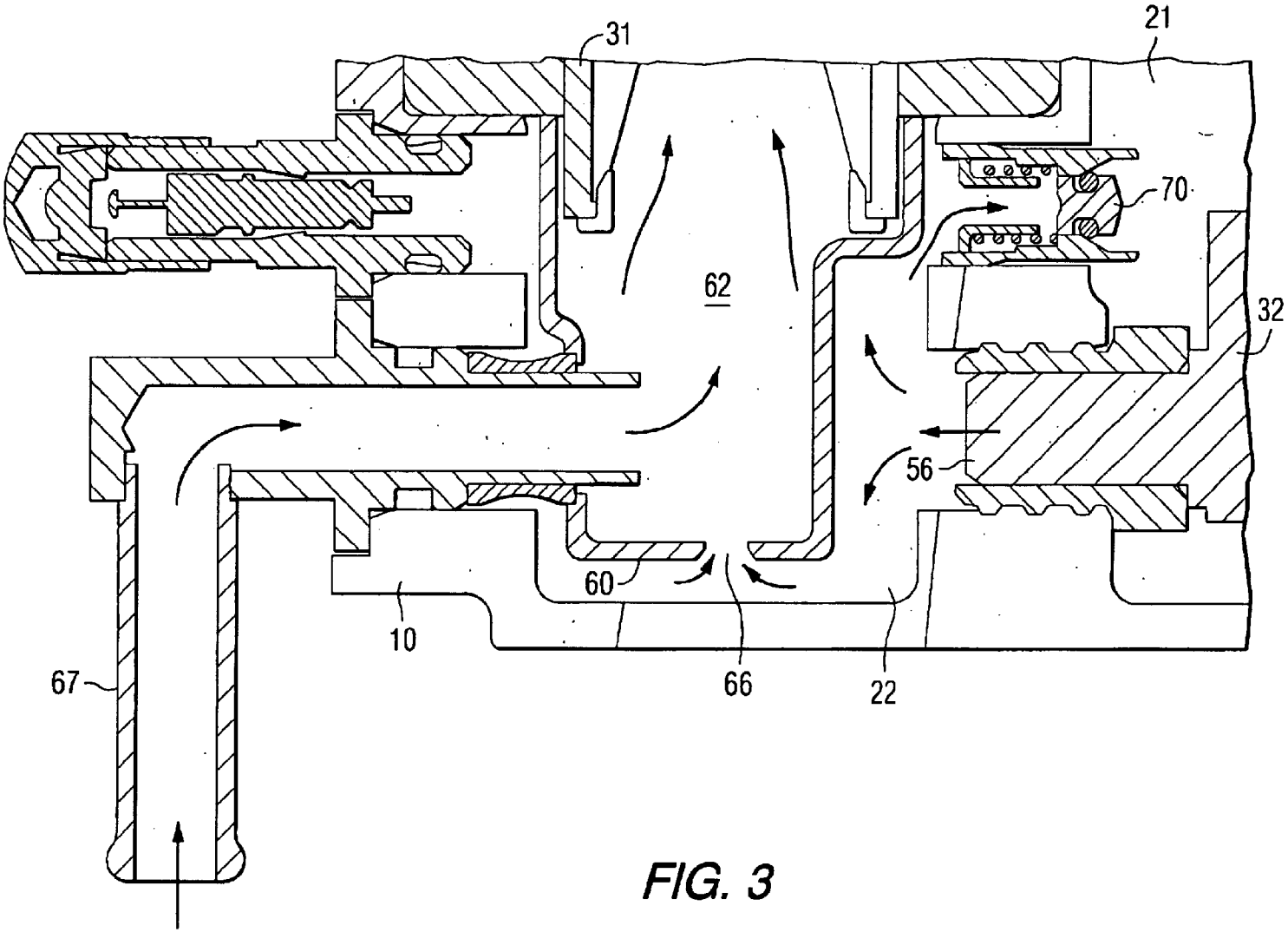
FIG. 3 is an enlarged portion of the illustration in FIG. 2.

FIG. 3 is an enlarged portion of FIG. 2, showing the flow directing component 60 and its surrounding structure. The arrows in FIG. 3 represent the predominate flow of fuel during operation of the present invention. Fuel returning from the fuel rail, through conduit 67, is directed into the internal cavity 62 of the flow directing component 60. It is inhibited, by the flow directing component 60, from mixing with the fuel contained in the second reservoir 22 outside of the flow directing component 60 and essentially with the fuel in the first reservoir 21. Instead, this recirculated fuel is drawn from the internal cavity 62 by the first pump 31 and conducted back to the fuel rail 44, as described above in conjunction with FIG. 1. The second pump 32, meanwhile, continues to pump fuel into the second reservoir 22 from the first reservoir 21, as described above in conjunction with FIG. 1. When the quantity of fuel pumped by the second pump 32 exceeds that which is demanded by the engine 50, the pressure within the second reservoir 22 increases and exceeds the pressure setting of the check valve 70. This allows the fuel to pass through the check valve 70 and back into the first reservoir 21. When the fuel in the fluid circuit comprising the first pump 31, internal cavity 62, and fuel rail 44 is partially depleted by the operation of the engine 50, the pressure within the internal cavity 62 drops to a magnitude that is less than the pressure within the second cavity 22. This induces a flow of liquid fuel from the second cavity 22, through orifice 66, into the internal cavity 62 and, eventually, through the first pump 31 to the fuel rail 44.

Figure 4:
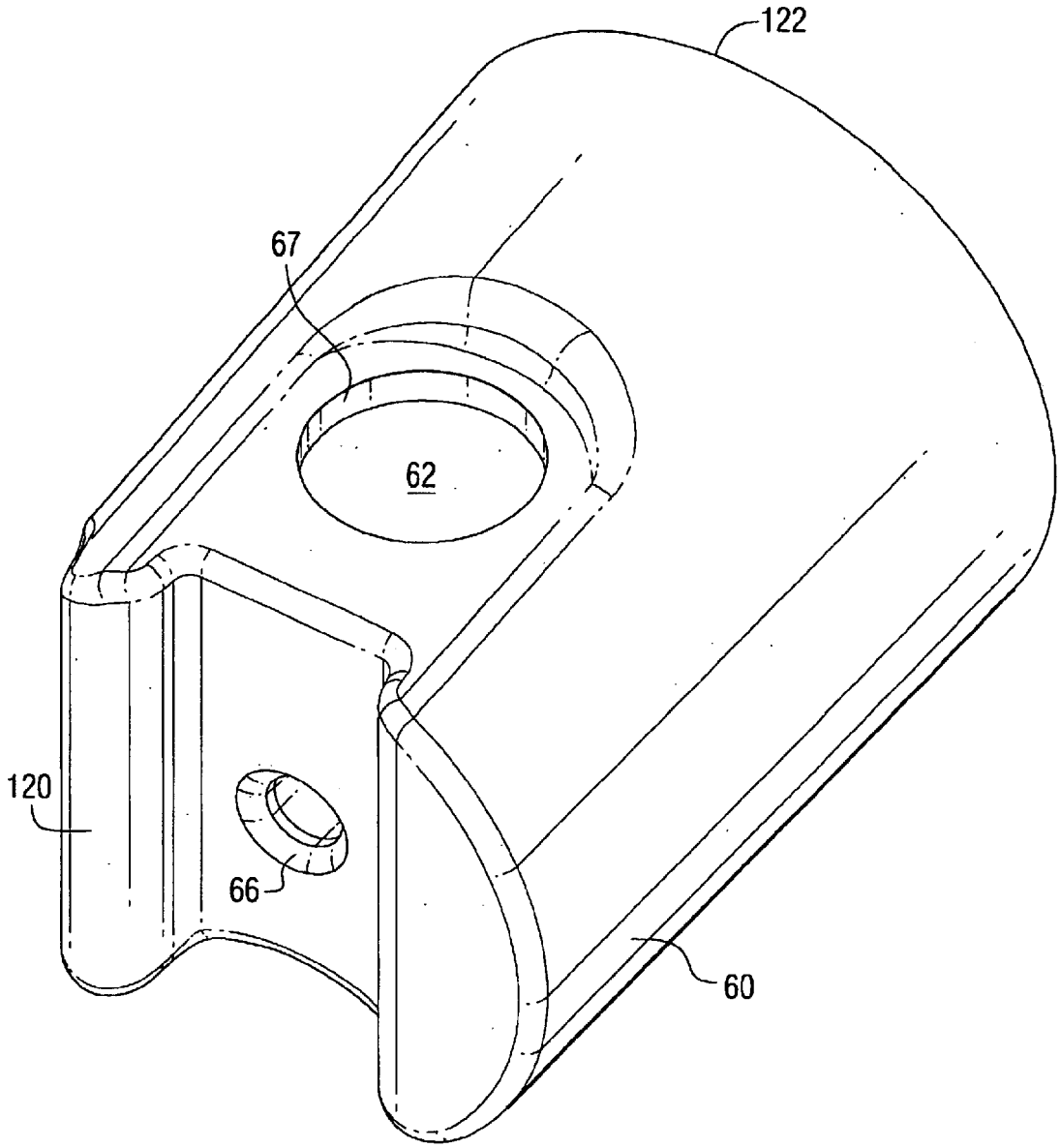
FIG. 4 is an isometric representation of the flow directing component of the present invention.

FIG. 4 is an isometric view of the cup-shaped flow directing component 60. The bottom portion 120 of the flow directing component 60 is shaped for a particular purpose that is not directly associated with the operation of the present invention and is therefore not limiting to the present invention. The conduit 67, which receives recirculating fuel as represented by dashed arrow 102 in FIG. 1, is provided to allow the recirculating fuel to enter the flow directing component 60 and flow into the internal cavity 62 within it. The orifice 66, as described above in conjunction with FIGS. 1, 2, and 3, is shaped to allow a flow of liquid fuel from the second reservoir 22 to the internal cavity 62 of the flow directing component 60. In one embodiment, the orifice 66 is approximately 0.125 inches in diameter. The upper end 122 of the flow directing component 60 is an opening that is shaped to be attached to the lower end of the first pump 31 shown in FIG. 1. This attachment defines the containment of the internal cavity 62 and allows fuel to flow into the internal cavity 62 only through the recirculating conduit 67 or the orifice 66.

Although the present invention has been described in particular detail and illustrated with significant specificity to show a preferred embodiment, it should be understood that alternative embodiments are also within its scope.

I claim:

1. A fuel delivery system for a marine engine, comprising:

first and second reservoirs;

a first pump having an inlet connected in fluid communication with said second reservoir and an outlet connectable in fluid communication with a fuel delivery component of said marine engine;

a second pump having an inlet connected in fluid communication with said first reservoir and an outlet connected in fluid communication with said second reservoir; and a flow directing component having an internal cavity which is connected in fluid communication with said inlet of said first pump, said flow directing component having an orifice that connects said internal cavity in fluid communication with said second reservoir.

2. The system of claim 1, further comprising:

a check valve connected in fluid communication between said first and second reservoirs to allow fluid to flow from said second reservoir into said first reservoir in response to a pressure of said fluid within said second reservoir exceeding a predetermined threshold.

3. The system of claim 1, further comprising:

a third reservoir connected in fluid communication with said first reservoir; and a fuel filter disposed within said third reservoir.

4. The system of claim 3, further comprising:

a third pump having an outlet connected in fluid communication with said third reservoir and an inlet connectable in fluid communication with a fuel tank, said fuel filter being connected in fluid communication between said outlet of said third pump and said first reservoir.

5. The system of claim 3, wherein:

said fuel filter is a water separating fuel filter.

6. The system of claim 1, wherein:

said fuel delivery component comprises a fuel rail.

7. The system of claim 6, wherein:

said fuel rail is connected in fluid communication between said outlet of said first pump and a return conduit connected in fluid communication with said internal cavity, whereby fuel is pumped into said fuel rail by said first pump and a quantity of said fuel can return to said internal cavity.

8. The system of claim 1, wherein:

said first pump is disposed within said first reservoir.

9. The system of claim 1, wherein:

said second reservoir is disposed within said first reservoir.

10. The system of claim 1, wherein:

said flow directing component is disposed within said second reservoir.

11. The system of claim 1, wherein:

said second pump is disposed within said first reservoir.

12. A fuel delivery system for a marine engine, comprising:

a first reservoir;

a first pump having an inlet connected in fluid communication with said first reservoir and an outlet connectable in fluid communication with a fuel delivery component of said marine engine;

a flow directing component having an internal cavity which is connected in fluid communication with said inlet of said first pump, said flow directing component having an orifice that connects said internal cavity in fluid communication with said first reservoir, said flow directing component having an inlet connected in fluid communication with an outlet of said fuel delivery component for receiving fluid from said fuel delivery component, said flow directing component inhibiting fluid flow from said fuel delivery component into said first reservoir except through said orifice;

second and third reservoirs, said fuel delivery component being a fuel rail, said inlet of said first pump being connected in fluid communication with said second reservoir and an outlet connectable in fluid communication with said fuel rail of said marine engine;

a second pump having an inlet connected in fluid communication with said first reservoir and an outlet connected in fluid communication with said second reservoir; and a check valve connected in fluid communication between said first and second reservoirs to allow fluid to flow from said second reservoir into said first reservoir in response to a pressure of said fluid within said second reservoir exceeding a predetermined threshold, said third reservoir being connected in fluid communication with said first reservoir.

13. The system of claim 12, further comprising:

a fuel filter disposed within said third reservoir; and a third pump having an outlet connected in fluid communication with said third reservoir and an inlet connectable in fluid communication with a fuel tank, said fuel filter being connected in fluid communication between said outlet of said third pump and said first reservoir.

14. The system of claim 12, wherein:

said fuel filter is a water separating fuel filter.

15. The system of claim 13, wherein:

said fuel rail is connected in fluid communication between said outlet of said first pump and a return conduit connected in fluid communication with said internal cavity, whereby fuel is pumped into said fuel rail by said first pump and a quantity of said fuel can return to said internal cavity.

16. The system of claim 15; wherein:

said first pump is disposed within said first reservoir;

said second reservoir is disposed within said first reservoir; and said flow directing component is disposed within said second reservoir.

17. The system of claim 16, wherein:

said second pump is disposed within said first reservoir.

18. A fuel delivery system for a marine engine, comprising:

first, second, and third reservoirs;

a first pump having an inlet connected in fluid communication with said second reservoir and an outlet connectable in fluid communication with a fuel rail of said marine engine;

a second pump having an inlet connected in fluid communication with said first reservoir and an outlet connected in fluid communication with said second reservoir;

a flow directing component having an internal cavity which is connected in fluid communication with said inlet of said first pump, said flow directing component having an orifice that connects said internal cavity in fluid communication with said second reservoir;

a check valve connected in fluid communication between said first and second reservoirs to allow fluid to flow from said second reservoir into said first reservoir in response to a pressure of said fluid within said second reservoir exceeding a predetermined threshold, said third reservoir being connected in fluid communication with said first reservoir;

a fuel filter disposed within said third reservoir;

a third pump having an outlet connected in fluid communication with said third reservoir and an inlet connectable in fluid communication with a fuel tank, said fuel filter being connected in fluid communication between said outlet of said third pump and said first reservoir, said fuel rail being connected in fluid communication between said outlet of said first pump and a return conduit connected in fluid communication with said internal cavity, whereby fuel is pumped into said fuel rail by said first pump and a quantity of said fuel can return to said internal cavity.

19. The system of claim 18, wherein:

said first pump is disposed within said first reservoir;

said second reservoir is disposed within said first reservoir;

said flow directing component is disposed within said second reservoir; and said second pump is disposed within said first reservoir.

* * * * *